United States Patent [19]

Jinnai et al.

[11] 4,369,964

[45] Jan. 25, 1983

[54] SHEET FEED APPARATUS FOR PRINTER OR THE LIKE

[75] Inventors: Koichiro Jinnai; Michio Umezawa, both of Tokyo, Japan

[73] Assignee: Ricoh Company, Ltd., Tokyo, Japan

[21] Appl. No.: 219,757

[22] Filed: Dec. 23, 1980

[30] Foreign Application Priority Data

Dec. 31, 1979 [JP] Japan ..... 54-171094
Dec. 31, 1979 [JP] Japan ..... 54-171095

[51] Int. Cl.[3] ..... B65H 7/06; B65H 7/20

[52] U.S. Cl. ..... 271/260; 137/599; 271/276

[58] Field of Search ..... 271/260, 261, 108, 96, 271/276, 196, 194, 197, 258; 137/599

[56] References Cited

U.S. PATENT DOCUMENTS

| | | | |
|---|---|---|---|
| 3,633,239 | 1/1972 | Meyerhoefer | 137/599 X |
| 3,663,012 | 5/1972 | Van Den Honert | 271/96 X |
| 4,127,265 | 11/1978 | Wire et al. | 271/260 |
| 4,191,215 | 3/1980 | Gonner | 137/599 X |
| 4,202,542 | 5/1980 | Lammers et al. | 271/276 |

FOREIGN PATENT DOCUMENTS

| | | | |
|---|---|---|---|
| 732670 | 8/1951 | United Kingdom | 271/260 |

*Primary Examiner*—Bruce H. Stoner, Jr.
*Attorney, Agent, or Firm*—David G. Alexander

[57] ABSTRACT

A drum (13) is provided with vacuum openings (14), (16), for suckingly holding a sheet (19) thereto for printing or the like. A sheet feed failure is detected by sensing for a drop in the level of vacuum at a vacuum source (12) below a predetermined value. Several regulators (36), (37), (38), (39) are provided for regulation to selected levels of vacuum.

4 Claims, 7 Drawing Figures

SHEET FEED APPARATUS FOR PRINTER OR THE LIKE

BACKGROUND OF THE INVENTION

The present invention relates to a sheet feed apparatus for a lithographic printing machine or the like. More specifically, the present invention relates to an apparatus comprising a drum formed with vacuum openings for suckingly holding a sheet thereto for printing or the like.

In this type of apparatus, a drum is formed with openings such as slots and a sheet is fed thereto and suckingly held to the drum by vacuum applied to the openings. With the sheet held thusly tight to the drum, an image is printed on the sheet by a lithographic or other printing process, after which the sheet is fed away from the drum.

A problem which has remained unsolved in this type of apparatus is that sheet feed failures occasionally occur which must be detected and cleared before further printing operations can be performed. Conventional means for sensing for sheet feed failures utilize microswitches, photosensors and the like to detect the feeding of a sheet to a particular position. Failure of the sheet to be sensed means that a sheet feed failure has occurred. Such sensors are costly and involve complicated and expensive auxiliary circuitry.

Another problem is that the level of vacuum must be adjusted to correspond to the thickness of the sheet being fed. The obvious solution is to provide a regulator valve which is set by the operator after selecting the thickness of the sheets. Such a regulator valve is highly subject to missetting or being ignored.

Yet another problem is that different levels of vacuum must be provided for feeding the sheet to the drum and feeding the sheet away from the drum. If the vacuum is set to the proper value for feeding the sheet to the drum and unchanged while feeding the sheet away from the drum, the level of vacuum will be too low and the sheet will not be fed away from the drum. Conversely, if the vacuum is set to a high value for feeding sheets away from the drum and employed for feeding sheets to the drum, there is a good possibility that two sheets will be fed to the drum.

Such changeover of levels of vacuum may be accomplished by means of two or more vacuum sources and selector valve means. However, the cost of such an arrangement is unreasonably high and changeover generally requires more than 12 seconds before stable vacuum is achieved.

SUMMARY OF THE INVENTION

A sheet feed apparatus embodying the present invention includes a drum formed with openings, a vacuum source communicating with the openings so that a sheet is suckingly adhered to the drum by vacuum at the openings, means for feeding the sheet to the drum and means for feeding the sheet away from the drum, and is characterized by comprising sensor means for sensing when a level of vacuum at the source drops below a predetermined value and producing an output signal in response thereto.

In accordance with the present invention, a drum is provided with vacuum openings for suckingly holding a sheet thereto for printing or the like. A sheet feed failure is detected by sensing for a drop in the level of vacuum at a vacuum source below a predetermined value. Several regulators are provided for regulation to selected levels of vacuum.

It is an object of the present invention to provide an improved sheet feed apparatus comprising means for sensing a sheet feed failure and regulating a level of vacuum to a desired level.

It is another object of the present invention to provide a generally improved sheet feed apparatus.

Other objects, together with the foregoing, are attained in the embodiments described in the following description and illustrated in the accompanying drawing.

DESCRIPTION OF THE PREFERRED EMBODIMENTS

While the sheet feed apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
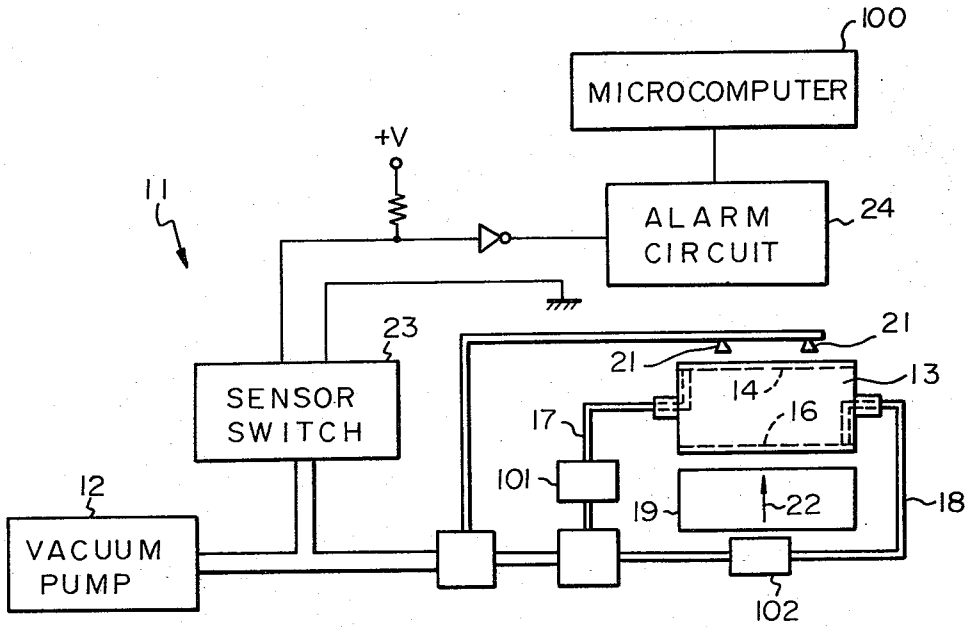
FIG. 1 is a diagram illustrating a first embodiment of the present invention.

Referring now to FIG. 1 of the drawing, a sheet feed apparatus embodying the present invention is generally designated by the reference numeral 11 and comprises a vacuum source or pump 12. A rotary drum 13 is provided with longitudinal slots 14 and 16 which communicate with the pump or source 12 through conduits 17 and 18 respectively. A sheet 19 is conveyed or fed to the drum 13 by movable suckers 21 which also communicate with the source 12 in the direction of an arrow 22. Due to vacuum at the slot 14, the leading edge of the sheet 19 is suckingly adhered to the drum 13 and the sheet 19 is wound around the drum 13 due to rotation thereof. The trailing edge of the sheet 19 is adhered to the drum 13 due to vacuum at the slot 16. With the leading and trailing edges of the sheet 19 thus held, the sheet 19 is tightly retained by the drum 13.

After the operation of feeding the sheet 19 to the drum 13 and adhering the sheet 19 thereto is completed, an image is printed on the sheet 19 by a lithographic printer or the like which is not part of the present invention and is not shown. Then, the sheet 19 is fed away from the drum 13 by the suckers 21.

The present invention is based on the fact that if the sheet 19 is not correctly fed to and wrapped around the drum 13, one or both of the slots 14 and 16 will not be covered by the sheet 19 and the level of vacuum produced by the pump 12 will drop. Such a drop in the level of vacuum below a predetermined value is detected by a sensor switch 23 which is turned on or closed in response thereto. When closed, the sensor switch 23 produces an output signal which is applied to an alarm control circuit 24 which energizes an alarm constituting a part thereof and causes further action.

Figure 2:
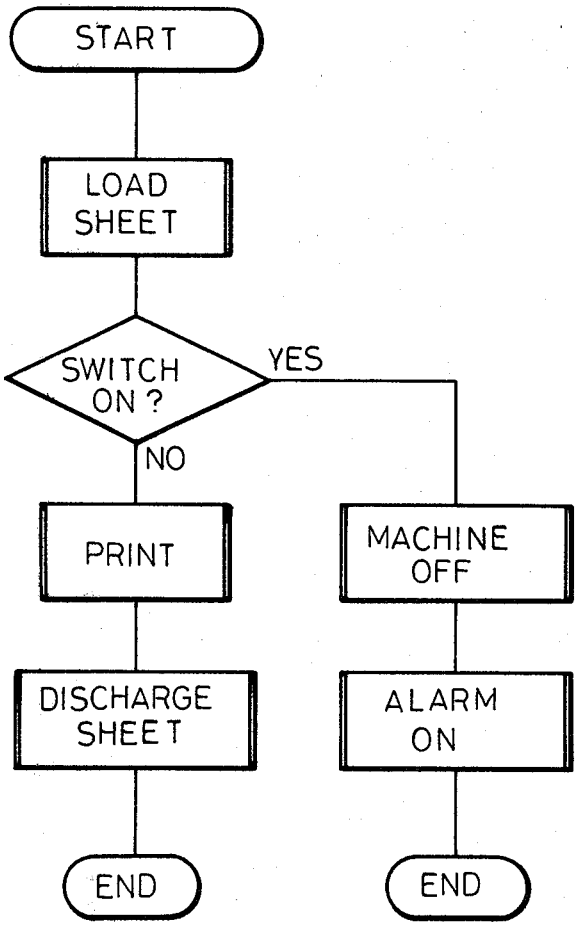
FIGS. 2 and 3 are flowcharts illustrating the operation of the embodiment.

FIG. 2 illustrates the operation of the circuit 24 in a mode of operation in which the sheet 19 is fed to the drum 13 and printed in the manner described above. If the switch 23 is on, indicating a sheet feed failure, the apparatus 11 is turned off except for the alarm which is turned on.

Figure 3:
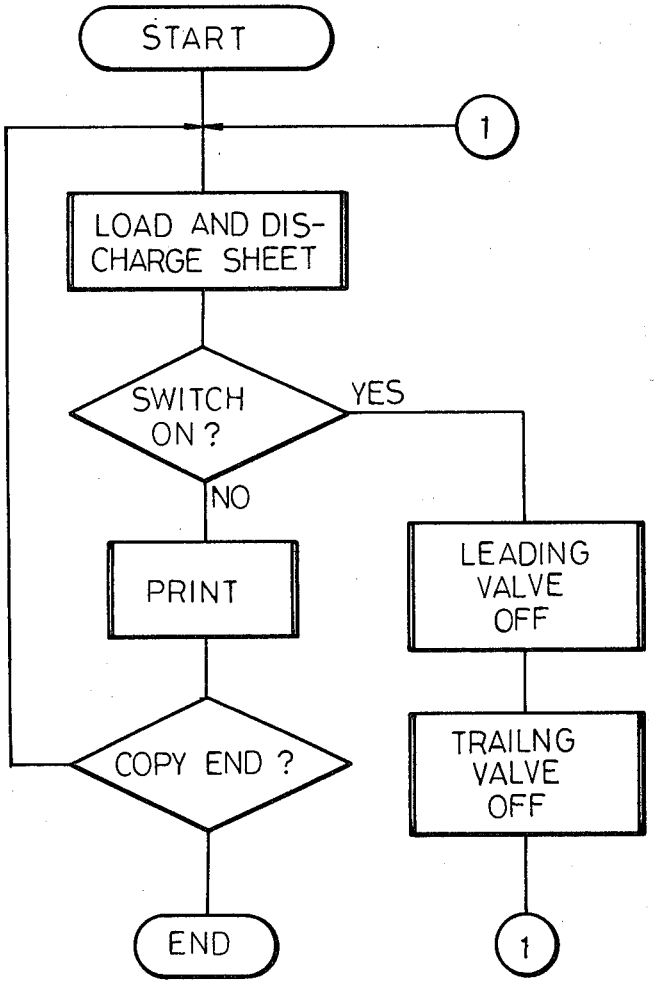

FIG. 3 illustrates another mode of operation in which one sheet is being fed to the drum 13 while another sheet is being discharged therefrom. If the switch 23 is on, valves 101 and 102 disposed in the conduits 17 and 18 are closed and the operation branches back to the first step.

Figure 4:
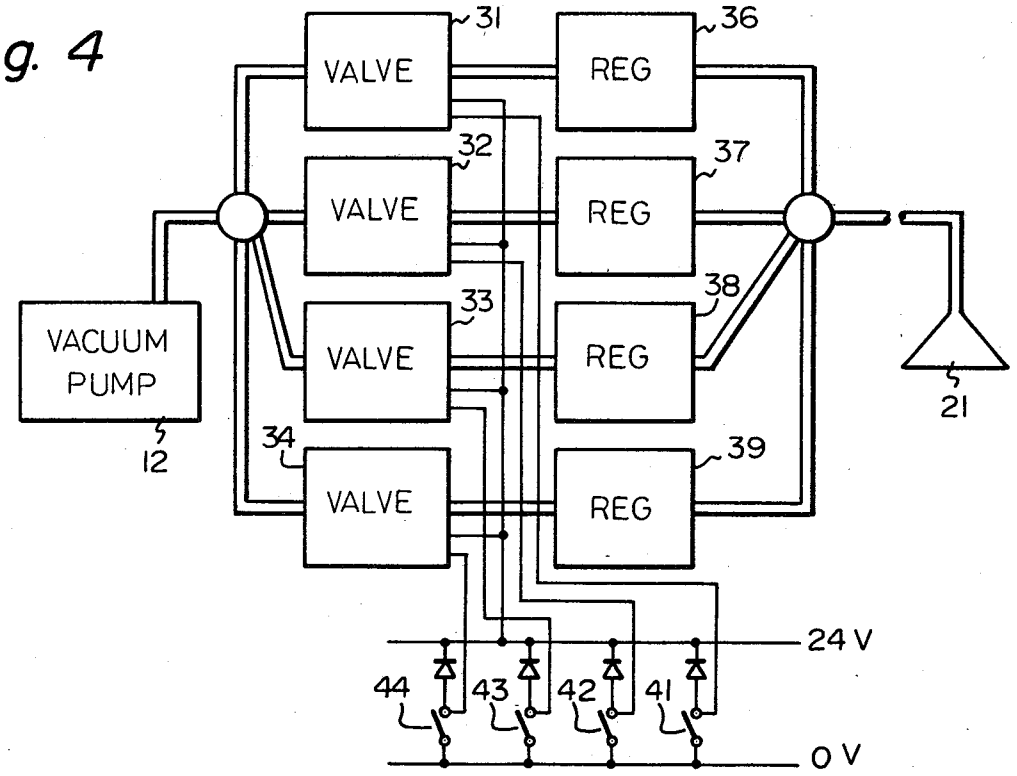
FIGS. 4 to 7 are diagrams illustrating modified embodiments of the present invention.

FIG. 4 illustrates another embodiment of the present invention comprising improved means for regulating the level of vacuum applied to the suckers 21 and slots 14 and 16 to a selected predetermined value which corresponds to the thickness of the sheet 19. In this embodiment, solenoid valves 31 to 34 are connected in parallel with each other and in series with vacuum regulators 36 to 39 between the pump 12 and the suckers 21. Although not illustrated, the outputs of the regulators 36 to 39 also communicate with the slots 14 and 16. The regulators 36 to 39 regulate the output vacuum thereof by controlling the sectional area through which the vacuum acts. Switches 41 to 44 are connected to the valves 31 to 34 and open the respective valves 31 to 34 when turned on or closed. One of the switches 41 to 44 is closed automatically or by the operator to select the level of vacuum corresponding to the thickness of the sheet 19.

The regulator 36, for example, may be constructed to provide an output vacuum of 30 cmHg for feeding sheets of standard weight 110 kg. The regulator 37 may produce an output vacuum of 8 cmHg for feeding standard sheets of 70 kg. The regulator 38 may produce an output vacuum of 5 cmHg for 55 kg sheets. The regulator 39 may be adjustable by the operator for the feeding of sheets of non-standard weight or thickness or standard sheets having weights other than 110, 70 and 55 kg.

Figure 5:
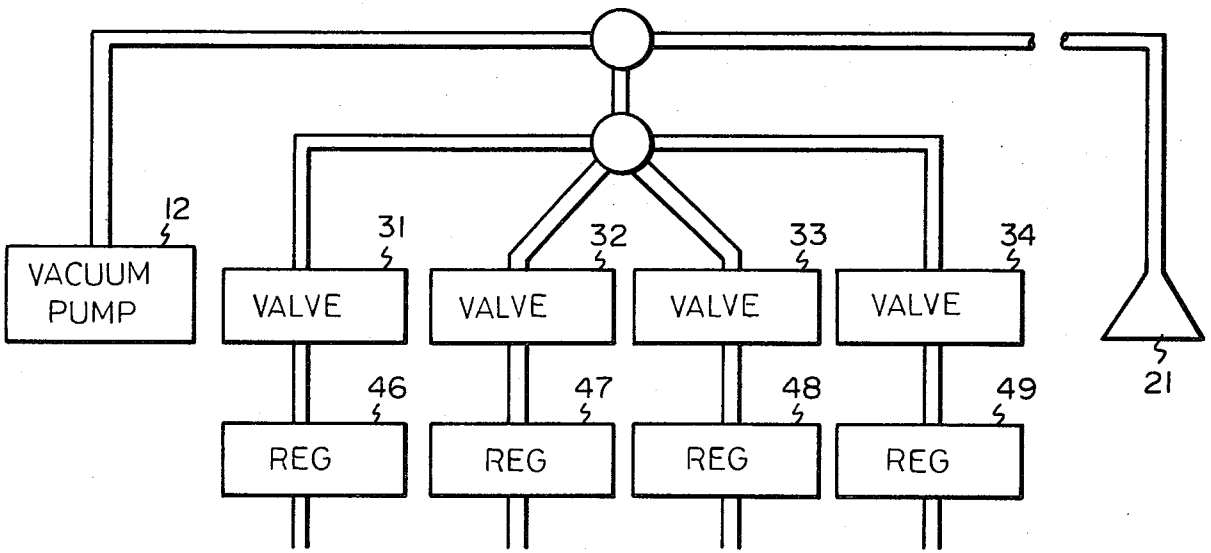

Whereas the regulators 36 to 39 regulate the vacuum by controlling the sectional area through which the vacuum acts, in FIG. 5 regulators 46 to 49 are connected in parallel with each other between the vacuum pump 12 and the atmosphere. The valves 46 to 49 provide the same function as the valves 36 to 39 respectively but are constructed to regulate the level of vacuum by controlling the sectional area of communication of the pump 12 with the atmosphere.

As discussed hereinabove, it is desirable to provide different levels of vacuum for feeding sheets to the drum 13 and feeding sheets away from the drum 13. It is also desirable to provide different levels of vacuum for a mode in which a sheet is discharged from the drum 13 before feeding another sheet thereto and a mode in which a sheet is discharged from the drum 13 while another sheet is being fed thereto. The embodiments of FIGS. 6 and 7 may be utilized in either of these two cases.

Figure 6:
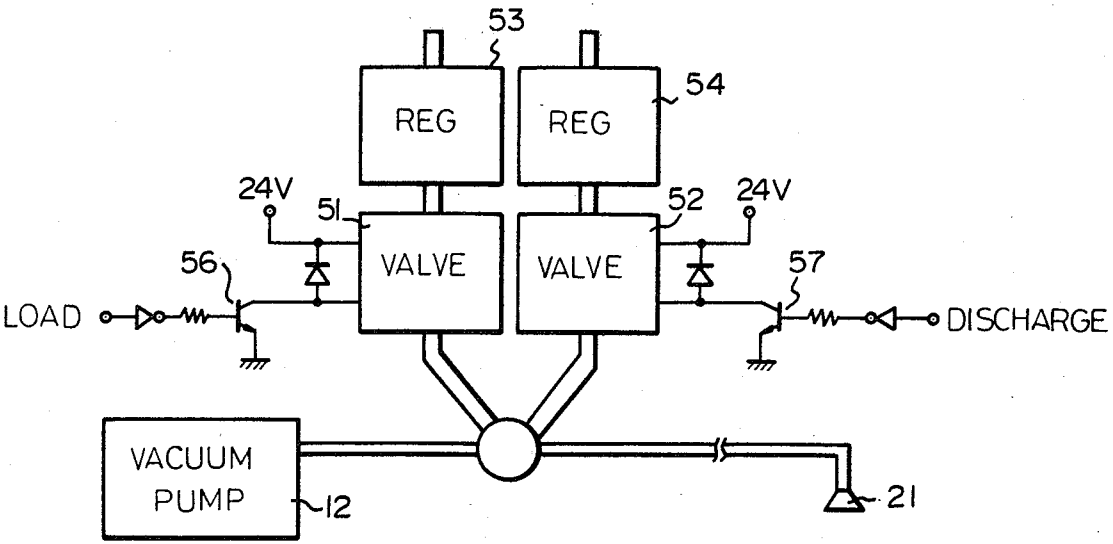

In FIG. 6, solenoid valves 51 and 52 are provided for selectively connecting regulators 53 and 54 to the pump 12. The regulators 53 and 54 are of the type used in FIG. 5 and communicate with the atmosphere. When a logically high LOAD signal is applied to a switching transistor 56 from a microcomputer 100 which controls the operation of the apparatus or a manual switch (not shown), the transistor 56 is turned on and grounds the valve 51 which opens and connects the pump 12 to the regulator 53. The LOAD signal is produced while the sheet 13 is being fed to the drum 13. A DISCHARGE signal is applied to a transistor 57 to open the valve 52 and connect the regulator 54 to the pump 12 while the sheet 13 is being fed away from the drum 13. Typically, the regulator 54 will regulate the vacuum to a level which is 2 cmHg higher than the level of the regulator 53.

Figure 7:
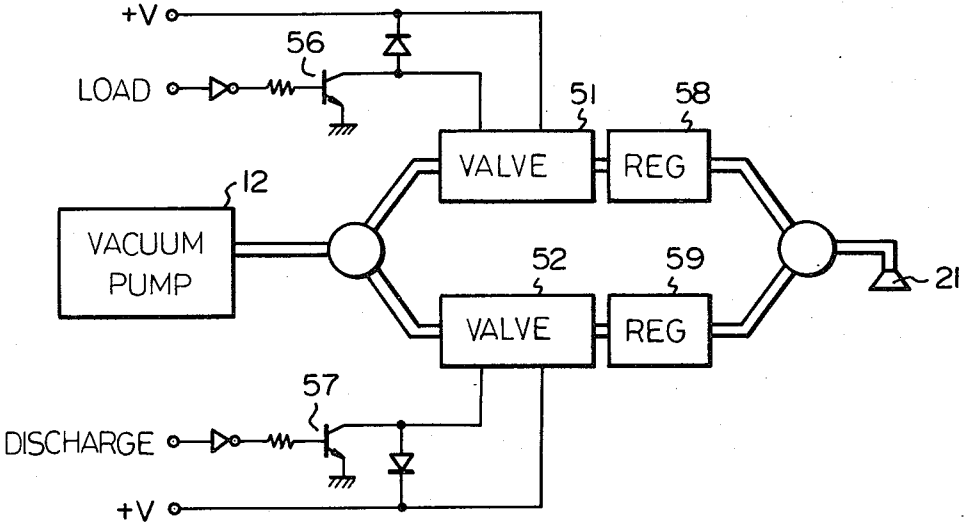

FIG. 7 illustrates another sheet feed apparatus which is similar to the apparatus of FIG. 6 except that the regulators 53 and 54 are replaced by regulators 58 and 59 which are of the type used in FIG. 4.

In summary, it will be seen that the present invention overcomes the drawbacks of the prior art and provides a substantially improved sheet feed apparatus. Various modifications will become possible for those skilled in the art after receiving the teachings of the present disclosure without departing from the scope thereof.

What is claimed is:

1. A sheet feed apparatus including a drum formed with openings, a vacuum source communicating with the openings so that a sheet is suckingly adhered to the drum by vacuum at the openings, means for feeding the sheet to the drum and means for feeding the sheet away from the drum, characterized by comprising:

sensor means for sensing when a level of vacuum at the source drops below a predetermined value and producing an output signal in response thereto;

valve means disposed between the vacuum source and the openings;

means responsive to the sensor means for, when the output signal is produced during feeding of the sheet to the drum, deenergizing the apparatus; and when the output signal is produced during feeding of the sheet away from the drum, resetting the apparatus to an initial condition with the valve means closed; and an alarm which is energized by the output signal.

2. An apparatus as in claim 1, further comprising a plurality of vacuum regulator means disposed between the source and the openings for regulating the vacuum to respective predetermined values and means for selectively turning on the regulator means.

3. An apparatus as in claim 2, in which the regulator means are connected in parallel with each other between the vacuum source and the openings.

4. An apparatus as in claim 2, in which the regulator means are connected in parallel with each other between the vacuum source and the atmosphere.

* * * * *